US005697129A

United States Patent [19]

Newville

[11] Patent Number: 5,697,129

[45] Date of Patent: Dec. 16, 1997

[54] SPECIAL PURPOSE TOOLS AND CLAMP FOR HOLDING THEM

[76] Inventor: Duane H. Newville, 6242 3rd Ave. South, St. Petersburg, Fla. 33707

[21] Appl. No.: 388,323

[22] Filed: Feb. 14, 1995

[51] Int. Cl.[6] ..... A44B 21/00

[52] U.S. Cl. ..... 24/339; 294/19.1

[58] Field of Search ..... 294/19.1, 33, 87.1, 294/87.2, 87.28, 99.1, 159; 24/335, 336, 339, 340, 341, 545, 563; 248/68.1, 229.1, 229.15, 229.16, 229.2, 229.25, 229.26, 316.1, 316.7, 541

[56] References Cited

U.S. PATENT DOCUMENTS

| | | | |
|---|---|---|---|
| 2,599,303 | 6/1952 | Ward | 24/339 X |
| 2,637,475 | 5/1953 | Gialanella | 294/87.2 X |
| 2,723,431 | 11/1955 | DiRenzo | 24/339 X |
| 2,996,329 | 8/1961 | Glazer | 294/87.2 |
| 3,223,148 | 12/1965 | Potye | 24/339 X |
| 3,636,595 | 1/1972 | Wines | 24/339 X |
| 3,797,792 | 3/1974 | Huber | 248/229.26 |
| 4,407,472 | 10/1983 | Beck | 24/339 X |
| 4,707,892 | 11/1987 | Nelson | 24/336 |
| 4,802,391 | 2/1989 | Willhoite et al. . | |
| 5,371,991 | 12/1994 | Bechtel et al. | 248/229.26 X |

*Primary Examiner*—Johnny D. Cherry
*Attorney, Agent, or Firm*—Joseph C. Mason, Jr.; Louise A. Foutch

[57] ABSTRACT

A clamp releasably engages a handle of a tool and simultaneously engages two tools that have utility when attached to the end of the handle. The base part of the clamp is C-shaped and is flexible and resilient to releasably engage the handle. Each tool-engaging part of the clamp is also C-shaped and made of a resilient, flexible material to releasably engage its associated tool. Each tool has a cylindrical sleeve that engages the distal end of the handle when in use and which is engaged by its associated clamp when not in use. The first tool has a pair of parallel, closely spaced apart fingers that engage an awning lock, pull down an awning, and install a tie down strap over a vehicle. The second tool removes and attaches a slider valve of the type found on recreational vehicle sewer or drain connections.

8 Claims, 3 Drawing Sheets

SPECIAL PURPOSE TOOLS AND CLAMP FOR HOLDING THEM

BACKGROUND OF THE INVENTION

1. Field of the Invention

This invention relates, generally, to special purpose tools and a clamp for holding such tools onto an elongate handle.

2. Description of the Prior Art

Several accessory parts for recreational vehicles (RVs) are hard to reach due to the large size of the vehicles. For example, many RV owners purchase an awning accessory and attach it to their RV so that an awning may be deployed when the vehicle is at a camp site or other rest stop. The awning usually is rolled up in an elongate cylindrical roller tube that is mounted along the uppermost edge of a preselected sidewall of the vehicle, i.e., along the edge of the vehicle's roof. The awning kit includes a lock means that prevents inadvertent deployment of the awning from the cylindrical roller tube when the vehicle is underway. The lock means is positioned at the end of the cylindrical tube, i.e., at roof height and is therefore out of easy reach to a person of average height. People typically use step ladders or chairs to reach the lock.

The typical awning assembly also includes a pull out strap which must be grasped and pulled to deploy the awning. Like the lock, the pull out strap is positioned near the top of the vehicle and cannot easily be reached.

Moreover, RVs often include a tie down strap that is deployed when the vehicle is parked. Deployment of the tie down strap is problematic because it must be positioned in overlying relation to the vehicle's roof and the cylindrical awning tube often gets in the way.

Finally, the sewer or waste water connections of a typical RV are typically mounted beneath the vehicle at a hard to reach location and are operated by a slider valve that is difficult to manipulate. Thus, opening and closing such slider valve is problematic.

Numerous tools have been developed over the years that perform special tasks, but one problem common to all of them is that they are easily lost. Most special tasks are performed only occasionally, so loss of special purpose tools is not uncommon.

Thus, there is a need for multipurpose tools that can assist an RV owner in performing the chores of locking and unlocking an awning roller tube, deploying an awning, deploying a tie down strap, opening and closing a slider valve; and the like. There is also a need for a means whereby the needed multipurpose tools could be stored in a convenient way to minimize the risk of loss. However, in view of the prior art at the time the present invention was made, it was not obvious to those of ordinary skill in this art how such a multi-purpose tool and storage means could be provided.

SUMMARY OF THE INVENTION

This invention includes three important parts. The first part is a multipurpose tool that engages an awning lock to lock and unlock an awning roller tube lock, that engages an awning pull down strap to facilitate awning deployment, and that guides a tie down strap over the deployed awning roller tube and awning. The second part is a tool adapted to engage a slider valve associated with RV sewer waste water connections. The third part is a clamp that holds both of said tools onto an elongate handle. The first tool will be referred to as the awning pull tool although said tool performs two other functions as well. The second tool will be referred to as the slider valve tool and the third tool will be referred to as the clamp.

The awning pull tool includes a cylindrical sleeve having an open trailing end for slidingly receiving a distal end of an elongate handle. The elongate handle, which may be of the telescoping type, enables a user to remain standing on the ground when using the tool overhead. A flat base member is formed integral with a leading end of the cylindrical sleeve, and the base member is coaxial with the cylindrical sleeve. A transversely extending first elongate projection of predetermined length is formed integrally with the base member, and said first elongate projection is disposed at a substantially ninety degree angle relative to a longitudinal axis of the cylindrical sleeve. A transversely extending second elongate projection having a second predetermined length less than the predetermined length of the first elongate projection is also formed integrally with the base member, and the second elongate projection is disposed at a substantially ninety degree angle relative to a longitudinal axis of the cylindrical sleeve and in parallel, coplanar, closely spaced apart relation to the first elongate projection. A strap-receiving space is defined between the first and second elongate projections.

The second elongate projection is formed in the base at a distal free end thereof and the first elongate projection is disposed proximal to the distal free end. Both of said first and second elongate projections have a rounded free end to facilitate entry of a strap into the strap-receiving space between the first and second elongate projections.

An awning strap is pulled by placing the first elongate projection in overlying relation to the strap and pulling the elongate handle in a downwardly and outwardly direction.

An awning is unlocked by inserting the first elongate projection into an opening formed in the lock handle, and manipulating the handle as required.

A tie down strap is lifted over the deployed awning roller tube by inserting the strap into the space between the first and second elongate projections, lifting a first end of the tie down strap over a first end of the awning roller tube, and walking along the length of the RV while maintaining the awning pull tool overhead. The strap will slide between the elongate projections as the tool user walks from the first end of the vehicle to the other, and the tie down strap will thus be guided over the awning roller tube. The tool is disengaged by withdrawing the tool from the strap.

The slider valve tool also has a cylindrical sleeve with an open trailing end that slideably but snugly accepts the distal end of an elongate handle, and a base is integrally formed therewith. A pair of transversely spaced apart, parallel fingers of equal length extend from the base and each of said fingers has a ninety degree bend formed therein.

A novel clamp is provided to avoid loss of the novel tools. The clamp itself is secured to the elongate handle, and both tools are clamped thereby. The novel clamp includes a base part having a flexible, resilient construction and a "C"-shaped configuration that releasably engages the elongate handle. A first clamp part having a flexible, resilient construction and a "C"-shaped configuration is formed directly and integrally with the base part and extends therefrom in a first lateral direction relative thereto. The base part and the first clamp part each have a predetermined longitudinal extent and each have a longitudinal axis of symmetry. The longitudinal axis of symmetry of the first clamp part is parallel to the longitudinal axis of symmetry of the base part. The second clamp part also has a flexible, resilient construction and a "C"-shaped configuration; it is formed directly and integrally with the base part and extends therefrom in a second lateral direction relative thereto. The base part and the second clamp part each have a predetermined longitudinal extent and each have a longitudinal axis of symmetry; the longitudinal axis of symmetry of the second clamp part is parallel to the longitudinal axis of symmetry of the first clamp part and the base part.

The second lateral direction of the second clamp part is diametrically opposite from the first lateral direction of the first clamp part so that the center points of the base part and the first and second clamp parts are laterally aligned with respect to one another.

Preferably, the respective longitudinal extents of the base part and the first and second clamp parts are substantially the same.

Thus, it is understood that the primary object of this invention is to provide special purpose tools for unlocking a roll up awning, reaching awning straps, lifting tie down straps into position, and facilitating the opening and closing of remotely positioned waste water slider valves.

Another important object is to provide another tool that facilitates protecting the special purpose tools from loss.

These and other important objects, features and advantages of the invention will become apparent as this description proceeds.

The invention accordingly comprises the features of construction, combination of elements and arangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
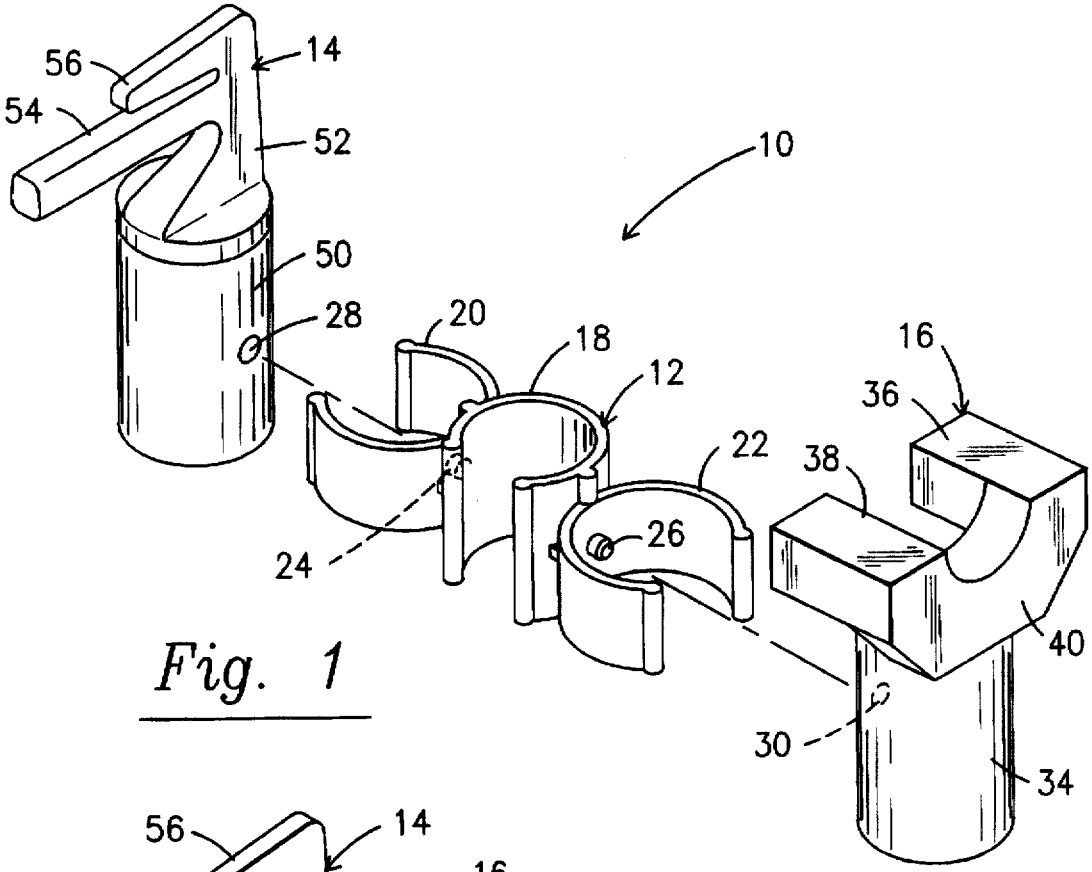
FIG. 1 is an exploded perspective view depicting the novel clamp and the novel parts it holds.

Referring now to FIG. 1, it will there be seen that an illustrative embodiment of the invention is denoted as a whole by the reference numeral 10.

The novel assembly 10 includes clamp 12, awning pull and tie down strap tool 14, and slider valve tool 16.

Clamp 12 includes a base part 18, a first clamp part 20, and a second clamp part 22, all three of said parts having a "C"-shaped configuration, having a predetermined longitudinal extent, and being made of a flexible, resilient material.

First clamp part 20 is formed directly and integrally with base part 18 and extends therefrom in a first lateral direction relative thereto. The longitudinal axis of symmetry of first clamp part 20 is parallel to the longitudinal axis of symmetry of base part 18.

Second clamp part 22 is also formed directly and integrally with base part 18 and extends therefrom in a second lateral direction relative thereto, said second lateral direction being diametrically opposite from said first lateral direction so that center points of said base part and said first and second clamp parts are laterally aligned with respect to one another. The longitudinal axis of symmetry of second clamp part 22 is parallel to the longitudinal axis of symmetry of first clamp part 20 and base part 18. Note that the respective longitudinal extents of base part 18 and said first and second clamp parts 20, 22 are substantially the same.

Note that the respective openings defined by first and second clamp parts 20, 22 open away from base part 18, and that the respective openings are normal to the points of direct and integral formation of the first and second clamp parts 20, 22 to the base part 18.

Figure 2:
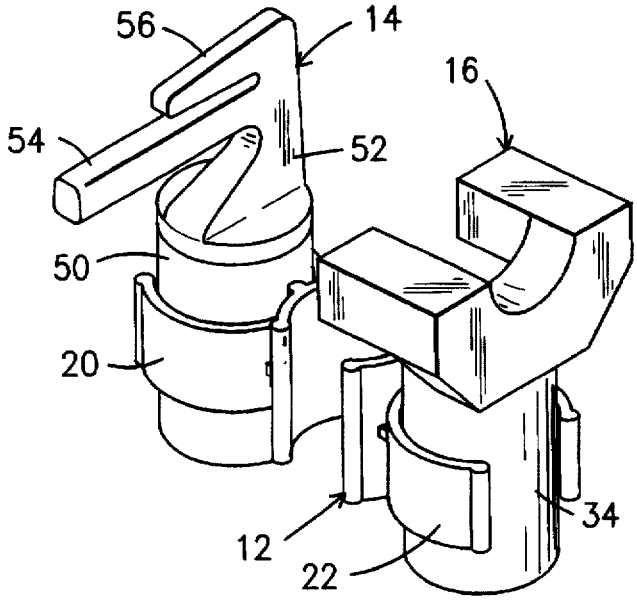
FIG. 2 is a perspective view of the same parts depicted in FIG. 1, but with the parts being held by the clamp.

Straight-in-configuration protuberances 24 and 26 are formed integrally with clamp parts 20 and 22 in the respective bight regions thereof; these protuberances have an extent substantially equal to the thickness of the clamp parts from which they extend and align with and snap fittingly engage alignment apertures 28 and 30 formed in tools 14 and 16, respectively. Such engagement prevents longitudinal slipping between the tools and their respective clamp parts, and also positions said tools in a preferred position of rotational adjustment as depicted in FIG. 2.

Figure 3:
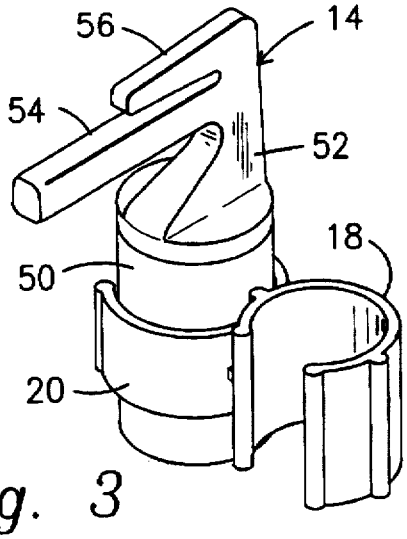
FIG. 3 is a perspective view of an alternative embodiment where the clamp is structured to hold only one part.

FIG. 3 depicts an alternative embodiment where only one clamp part 20 or 22 is attached to base 18.

Figure 4:
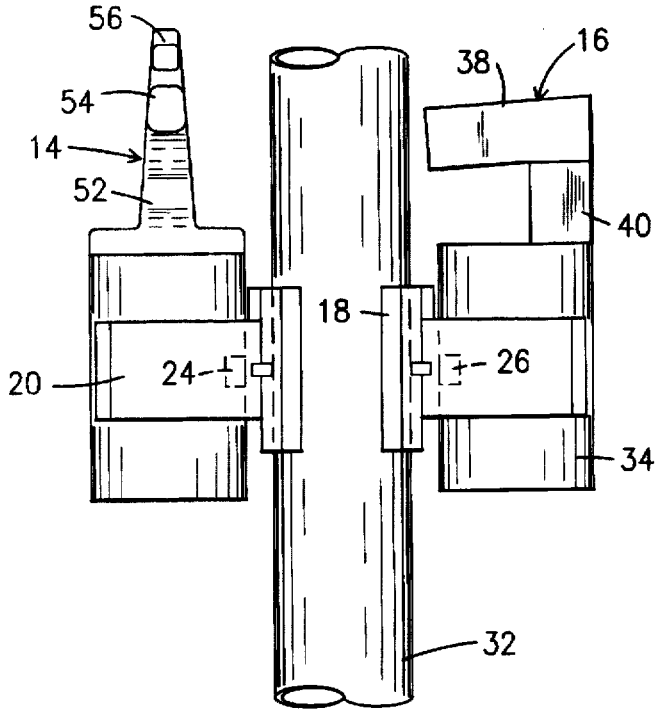
FIG. 4 is a side elevational view of the clamp when holding both parts.

When either embodiment is in use, base 18 releasably engages an elongate tubular handle 32, as indicated in FIG. 4, of a brush or other implement. This ensures that tools 14 and 16 will be available for use when needed, it being understood that said tools 14 and 16 may be selectively attached to the end of such an elongate tubular handle when a brush or other tool is removed therefrom.

Figure 5:
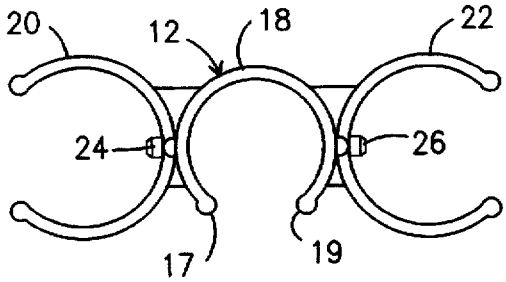
FIG. 5 is a top plan view of the novel clamp.
Figure 7:
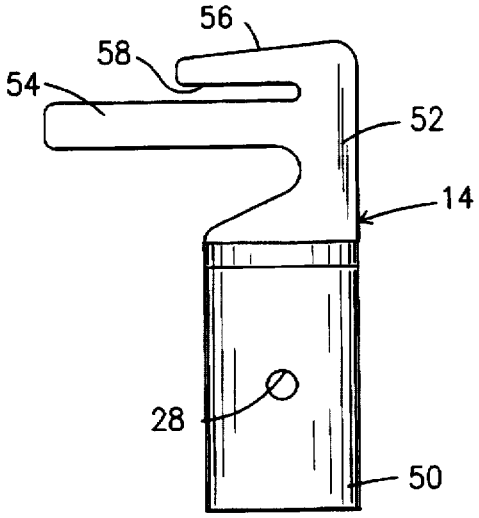
FIG. 7 is a side elevational view of the novel awning pull and tie down strap tool.

As perhaps best understood in connection with FIG. 5, the inner diameter of clamp 18 is slightly less than the outer diameter of handle 32 so that opposite ends 17, 19 of clamp 18 transiently diverge from one another when tube 32 is inserted into clamp 18, and converge toward one another after the handle has been fully received by the clamp. The aforesaid differences in diameters between clamp 18 and tube 32 result in a good frictional engagement therebetween so that relative slippage therebetween is inhibited.

Figure 6:
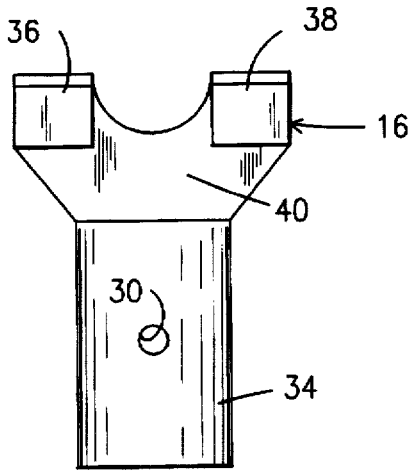
FIG. 6 is a front elevational view of the novel slider valve tool.

Slider valve tool 16 is depicted in elevation in FIG. 6, but its construction is best understood by comparing said FIG. 6 with FIGS. 1, 2, and 4. Tool 16 includes a cylindrical sleeve 34 having an inner diameter slightly greater then the external diameter of tube 32 so that said sleeve fits over and engages a distal free end of said tube 32 when tool 16 is to be used, it being understood that a brush or other tool, not shown, is releasably mounted to the distal free end of said tube and is removed to accommodate tool 16.

Figure 9:
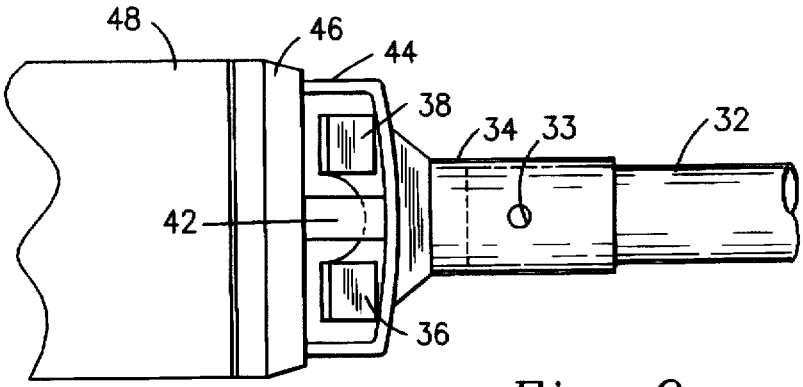
FIG. 9 is a side elevational view of the slider valve tool when engaged to a slider valve.

Tool 16 further includes a pair of parallel, transversely spaced apart, flat-topped fingers 36, 38 that are joined together by a bight region 40 that surmounts cylindrical sleeve 34. As best understood in connection with FIG. 9, fingers 36, 38 flank centerpost 42 and extend into open spaces on opposite sides thereof that are formed by handle 44 of slider valve 46 that is engaged to drain pipe 48. A biased peg 33, also depicted in FIG. 9, engages aperture 30 formed in cylindrical sleeve 34 to hold tool 16 onto the end of said handle 32 in the well known way. Peg 33 is a part of a well known locking device that is positioned within the hollow interior of tube 32 and forms no part of the invention.

Tool 14, depicted in FIGS. 1–4 and 7, includes a cylindrical sleeve 50 having an open trailing end for slidingly receiving a distal end of elongate tubular handle 32 and a flat base member 52 integral with a leading end of said cylindrical sleeve, said base member being coaxial with cylindrical sleeve 50.

Tool 14 further includes a transversely extending first elongate projection 54 of predetermined length integral with base member 52 and disposed at a substantially ninety degree angle relative to a longitudinal axis of cylindrical sleeve 50, and a transversely extending second elongate projection 56 integral with said base member. The second elongate projection is also disposed at a substantially ninety degree angle relative to a longitudinal axis of cylindrical sleeve 50 and is in parallel, coplanar, spaced apart relation to first elongate projection 54.

Second elongate projection 56 is formed in base 52 at a distal free end thereof and first elongate projection 54 is disposed proximal to said distal free end.

A strap-receiving space 58 (FIG. 7) is defined between said first and second elongate projections, said strap-receiving space having a size sufficient to receive therewithin a strap of the type used to tie down recreational vehicles.

A tie down strap is installed in overlying relation to a vehicle by placing a tie down strap into strap-receiving space 58 between said first and second elongate projections, lifting the tie down strap over a first end of a vehicle, and walking along the length of said vehicle, said strap sliding between said first and second elongate projections 54 and 56.

Figure 8:
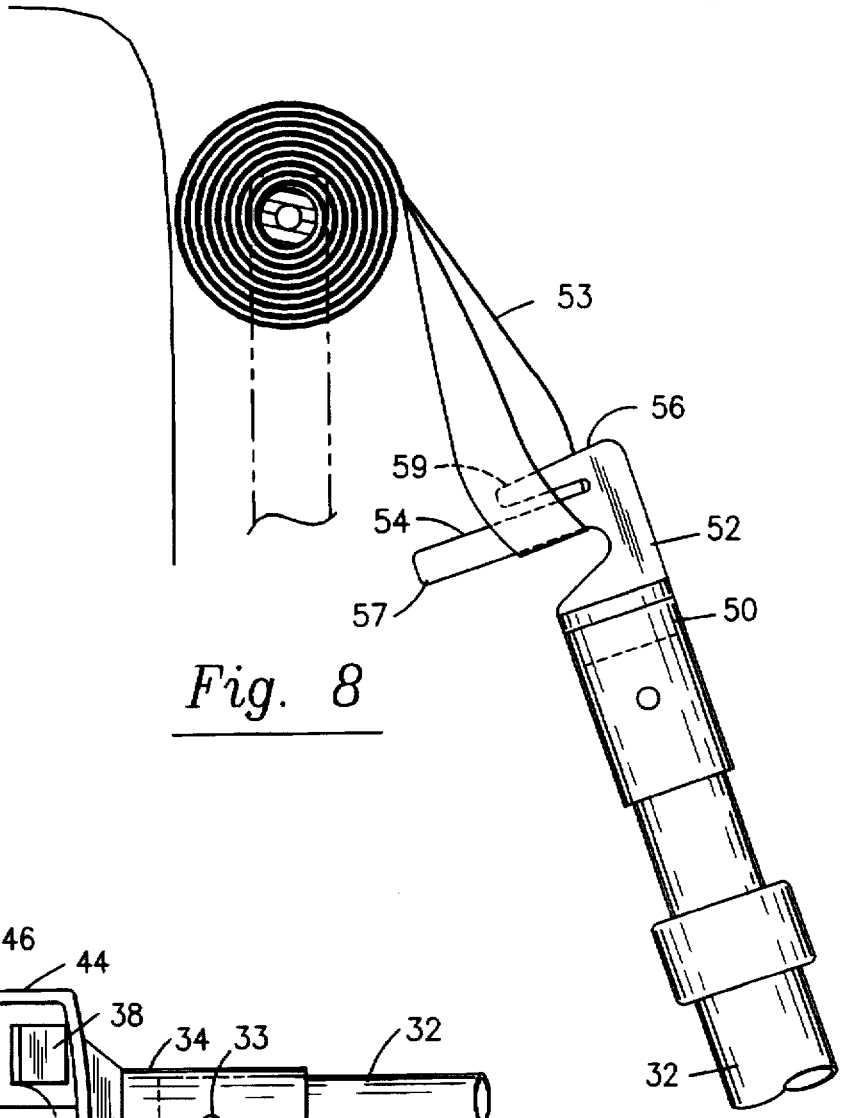
FIG. 8 is a side elevational view of the awning tool when pulling an awning down.

An awning strap 53 (FIG. 8) is pulled downwardly from housing 55 by placing first elongate projection 54 into overlying relation to said awning strap and pulling elongate handle 32 downwardly, and an awning lock, not shown, is locked or unlocked by inserting first elongate projection 54 into engagement therewith and manipulating said awning lock as needed.

Each of said first and second elongate projections has a rounded free end 57, 59 to facilitate entry of a strap into strap-receiving space 58.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A clamp comprising:

a base part having a "C"-shaped configuration, said base part made of a flexible, resilient material;

a first clamp part having a "C"-shaped configuration, said first clamp part made of a flexible, resilient material, said first clamp part formed directly and integrally with said base part and extending therefrom in a first lateral direction relative thereto, said base part and said first clamp part each having a predetermined longitudinal extent and each having a longitudinal axis of symmetry, said longitudinal axis of symmetry of said first clamp part being parallel to the longitudinal axis of symmetry of said base part;

a second clamp part having a "C"-shaped configuration, said second clamp part made of a flexible, resilient material, said second clamp part formed directly and integrally with said base part and extending therefrom in a second lateral direction relative thereto, said base part and said second clamp part each having a predetermined longitudinal extent and each having a longitudinal axis of symmetry, said longitudinal axis of symmetry of said second clamp part being parallel to the longitudinal axis of symmetry of said first clamp part and said base part; and a straight protuberance formed in a bight of said first clamp part, said straight protuberance having a predetermined extent and said straight protuberance extending toward an opening defined by said first clamp part.

2. The clamp of claim 1, wherein said predetermined extend of said straight protuberance being substantially equal to a thickness of said first clamp part.

3. The clamp of claim 1, further comprising a straight protuberance formed in a bight of said second clamp part, said straight protuberance having a predetermened extent and said straight protuberance extending toward an opening defined by said second clamp part.

4. The clamp of claim 3, wherein said predetermined extent of said straight protuberance being substantially equal to a thickness of said second clamp part.

5. The clamp of claim 3, wherein the respective longitudinal extents of said base part and said first and second clamp parts are substantially the same.

6. The clamp of claim 1, wherein said second lateral direction of said second clamp part is diametrically opposite from said first lateral direction of said first clamp part so that said base part and said first and second clamp parts are laterally aligned with respect to one another.

7. The clamp of claim 1, wherein said first clamp part has an opening that is normal to an opening defined by said base part.

8. The clamp of claim 1, wherein said second clamp part has an opening that is normal to an opening defined by said base part.

* * * * *

UNITED STATES PATENT AND TRADEMARK OFFICE

CERTIFICATE OF CORRECTION

PATENT NO. : 5,697,129
DATED : December 16, 1997
INVENTOR(S) : Duane H. Newville It is certified that error appears in the above-identified patent and that said Letters Patent is hereby corrected as shown below:

In Column 6, Line 38, the word 'extend' should be changed to 'extent'.

In Column 6, Line 42, the word 'predetermened' should be changed to 'predetermined'.

Signed and Sealed this

Fourteenth Day of April, 1998

Bruce Lehman

*Attest:*

BRUCE LEHMAN

*Commissioner of Patents and Trademarks*

*Attesting Officer*